US005623898A

United States Patent [19]

Bruton

[11] Patent Number: 5,623,898

[45] Date of Patent: Apr. 29, 1997

[54] VARIABLE DURATION HYDRAULIC VALVE LIFTERS

[76] Inventor: Murl L. Bruton, 7735-52 Mission Gorge Rd., Santee, Calif. 92071

[21] Appl. No.: 586,971

[22] Filed: Jan. 16, 1996

[51] Int. Cl.[6] ..... F01L 1/16; F01L 1/24

[52] U.S. Cl. ..... 123/90.35; 123/90.49; 123/90.55; 123/90.57

[58] Field of Search ..... 123/90.16, 90.35, 123/90.48, 90.49, 90.52, 90.55, 90.57

[56] References Cited

U.S. PATENT DOCUMENTS

| | | | |
|---|---|---|---|
| 3,304,925 | 2/1967 | Rhoads | 123/90.55 |
| 3,921,609 | 11/1975 | Rhoads | 123/90.55 |
| 4,524,731 | 6/1985 | Rhoads | 123/90.57 |
| 4,913,106 | 4/1990 | Rhoads | 123/90.49 |
| 4,977,867 | 12/1990 | Rhoads | 123/90.49 |
| 5,241,927 | 9/1993 | Rhoads | 123/90.16 |

*Primary Examiner*—Weilun Lo
*Attorney, Agent, or Firm*—Charles C. Logan, II

[57] ABSTRACT

Variable duration hydraulic lifters having either the conventional flat bottom surface or a roller mounted in their bottom end for engagement with a cam. The unique plungers have an upper portion and a lower portion whose outer cylindrical surfaces have grooves extending from their top edges to their bottom. The width of these grooves at their top end is less than their width at their bottom edges. Also these grooves may have a depth at their top edges that increases as it approaches their bottom edges. The benefits resulting from the unique grooves in the outer surface of the plunger includes reduced emissions, increased gas mileage, and an increase in the engines horsepower and torque.

18 Claims, 2 Drawing Sheets

VARIABLE DURATION HYDRAULIC VALVE LIFTERS

BACKGROUND OF THE INVENTION

The invention relates to hydraulic valve lifters and more specifically to variable duration valve lifters.

Variable duration hydraulic valve lifters are an improvement upon the basic hydraulic valve lifter which has applications in high-performance engines. The radical cam of high-performance engines causes valve overlap which is effective in improving engine performance at high speeds, but causes very rough engine performance at idling. The variable duration, or "bleed down", lifter solves this problem. U.S. Pat. Nos. 3,921,609, 4,524,731, and 4,913,106 are directed to prior art variable duration hydraulic valve lifters. Thorough descriptions of the purpose and functioning of bleed down hydraulic lifters are found in these patents.

When an engine is cammed for more power, its ability to breath is effectively increased by opening the valves wider and holding them open longer. Keeping them open longer is known as increasing the duration of the cam. Theoretically, the exhaust valve of each cylinder opens when the piston reaches bottom dead center of the power stroke and remains open as the piston rises to top dead center on the exhaust stroke. At this point the intake valve opens and the exhaust valve closes. This is generally speaking how the valves are timed on a stock engine.

In order to extend the total duration of the valves, the exhaust valve must open before the piston reaches bottom dead center and close after the piston reaches top dead center, and the intake valve opens before the piston reaches top dead center and closes after reaching bottom dead center. This gets into a situation known as overlap: the intake valve opens before the exhaust valve is fully closed producing a period when both valves are open simultaneously.

At high rpm, despite the overlap, the increase in the ability of the engine to breath increases engine power. However, at low rpm, just the opposite is true, and the more radically varied the cam is, the greater is the overlap period, and the greater the power loss at low rpm. A car modified with a radical cam is hard to start, idles very roughly, and lacks low speed power.

At low and mid-range rpm (3500 rpm or less) the overlapping of the exhaust and intake valves being open at the same time result in a loss of horsepower and torque, result in incomplete combustion causing increased emissions and a decrease in gas mileage.

Stock factory engines are set up to primarily use engine oils such as 5 wt, 10 wt, 20 wt, and 30 wt. They are designed to use multi-weight oils such as 10–30 wt, 10–40 wt, 15–40 wt, etc. Existing variable duration valve lifters having straight external grooves in the external surface of their plungers, such as described and illustrated in the Rhoads patents, cannot function efficiently with multigrade engine oils. The oil passes along these grooves in spurts and not with a controlled steady flow. The recovery time for the oil to leave the reservoir areas of the variable duration valve lifters, pass along their respective external grooves and return to their respective reservoir areas is excessive making their operation inefficient.

It is an object of the invention to provide a novel variable duration hydraulic valve lifter that will reduce emissions by accomplishing complete combustion of the gases burned in the engine.

It is also an object of the invention to provide a novel variable duration hydraulic valve lifter that will increase an engines horsepower and torque.

It is another object of the invention to provide a novel variable duration hydraulic valve lifter that will increase gas mileage.

It is a further object of the invention to provide a novel variable duration hydraulic valve lifter that can be used effectively with multiweight engine oils and which can provide a controlled steady bleed flow along its respective external grooves in its plunger.

It is an additional object of the invention to provide a novel variable duration hydraulic valve lifter that can drastically reduce the recovery time for oil to leave the reservoir areas and pass along their respective external grooves of the plunger and return to their respective reservoir areas.

SUMMARY OF THE INVENTION

The variable duration hydraulic valve lifter described herein is designed to provide favorable characteristics over the entire speed range. At low and intermediate speeds a closely controlled oil leak in the pressure chamber is permitted to prevent pumping up to a wholly solid condition. This is accomplished with uniquely configured grooves in the outer surface of the plunger of the valve lifter. These grooves extend the entire length of the upper portion from its top edge to its bottom edge and also on the bottom portion from its top edge to its bottom edge. Each of these grooves has a greater width at their bottom end than their width at their top end. The width of the grooves at their top end is in the range of 0.0042–0.0612 inches. The width of the grooves at their bottom end is in the range of 0.0150–0.0625 inches. The configuration of these grooves is referred to as a pyramid type cut. Also the depth of the grooves may increase from their top edge to their bottom edge. The depth at the top edge of the grooves is in the range of 0.0075–0.0150 inches. The depth of the grooves at their bottom edge is in the range of 0.0080–0.0180 inches.

Control tests have been conducted on a 1991 Ford pickup truck that was tuned-up to factory specifications. Then it was sent to a California smog station for testing. Once the smog testing was completed, it went to a wheel dyno for horsepower and torque testing. Thus provided with an accurate starting point established, the Ford pickup had the novel variable duration hydraulic valve lifters installed. No modification to the vehicle's engine of any kind was required nor was any retuning of the vehicle necessary following installation of the novel valve lifters. The Ford pickup was tested again at the smog station and on the wheel dyno. The testing revealed that the novel valve lifters made the following improvements: 91% reduction in hydrocarbons at idle, 37.5% reduction in hydrocarbons at 2500 rpm, elimination of deadly carbon dioxide at idle or at 2500 rpm, increased air flow through the engine, and 7.9% increase in horsepower and torque from the engine. The engine's warm-up time was also cut in half. An additional benefit was that there was an increase in gas mileage from 18.6 mpg. to 20.7 mpg.

The use of variable width grooves and/or variable depth grooves in the external surface of the plunger of the variable duration hydraulic valve lifters allows them to be effectively used with multiweight engine oils. In prior art variable duration valve lifters such as the Rhodes lifters, the external grooves in the plungers had a constant width and depth. It was therefore difficult for the oil in their respective reservoirs to enter the bottom ends of their respective grooves and also insure that there would be a continuous flow of motor oil up the length of the grooves. As a result, spurts of oil would be ejected from the top ends of the grooves instead of a controlled continuous flow and the valve lifters would operate inefficiently at low and mid-range rpm. This produces a lose of horsepower and torque, incomplete combustion causing increased emissions and a decrease in gas mileage.

The use of variable width grooves and/or variable depth grooves in the external surface of the plunger of the variable duration hydraulic valve lifter also decreases the recovery cycle time considerably for the oil to leave the respective reservoir areas at the bottom of the respective upper portion and lower portion of the plunger, pass along their respective external grooves and return to their respective reservoir areas. The recovery time can be reduced by as much as 50 percent or more.

DESCRIPTION OF THE PREFERRED EMBODIMENT

Figure 1:
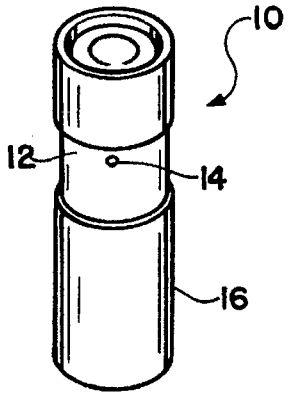
FIG. 1 is a front perspective view of the novel variable duration hydraulic valve lifter.

The novel variable duration hydraulic valve lifters will now be described by referring to FIGS. 1–8 of the drawings. A first variable duration hydraulic valve lifters is generally designated numeral 10. It is cylindrical in shape and it has an annular peripheral channel 12 located intermediate its top end and its bottom end. An oil port 14 communicates with the interior of cylindrical body 16. Cylindrical body 16 has a closed lower end 18.

Figure 2:
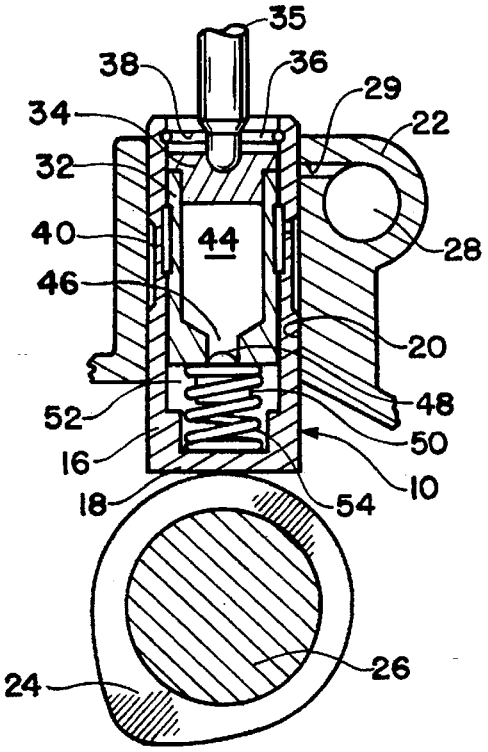
FIG. 2 is a vertical cross sectional view taken through the top end of an engine head showing the novel variable duration hydraulic lifter in its lowest position and FIG. 3 is a like vertical cross sectional view showing the variable duration hydraulic lifter in its highest position.

FIG. 2 shows the hydraulic valve lifter 10 axially slidably mounted in a bore 20 in a portion of the engine head casting 22. A single valve is shown, there being one lifter for each valve in the engine, with each lifter being operated by a lobe 24 on a cam shaft 26. Engine head casting 22 has an oil gallery 28 with a supply duct 29 in communication with bore 20 to supply oil to the lifter from the pressure side of the engine oil system.

Hydraulic valve lifter 10 has a hollow cylindrical plunger 32 that is axially slidable within cylindrical body 16. The upper end of plunger 32 has a cup 34 in which is seated the end of a push rod 35, the push rod being coupled to a conventional rocker arm and valve(not shown). Plunger 32 is retained by a snap ring 36 in a groove 38 within the upper end of cylindrical body 16. Cylindrical body 16 has an external peripheral collecting channel 40 which registers with the supply duct 29. A port 41 communicates from channel 40 to the interior of cylindrical body 16 and plunger 32 has a peripheral channel 12 which registers with port 41 at all times. Port 41 leads to the interior of plunger 32, so that oil is continuously emitted into the inner chamber 44 of the plunger from the oil gallery regardless of any rotation or axial displacement experienced by the lifter components.

At the lower end of plunger 32 is a small outlet 46, the lower end of which is closed by a check valve 48 having a ball valve(not shown) held in place against a seat by a spring (not shown), the spring and valve being held in place by a perforated retaining cage 50. The space between plunger 32 and the lower end of cylindrical body 16 comprises a pressure chamber 52 and in this chamber is a return spring 54 which biases the plunger upwardly out of the body until stopped by snap ring 36. In normal assembly the plunger 32 is pressed downwardly against return spring 54 by the push rod 35, which is loaded by the much stronger valve spring (not shown).

Figure 4:
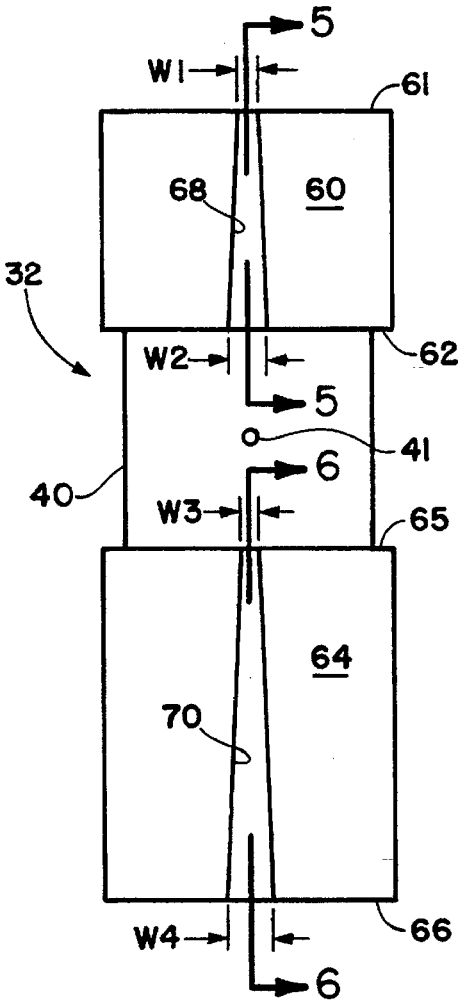
FIG. 4 is an enlarged front elevation view of the novel variable duration hydraulic valve lifter.
Figure 3:
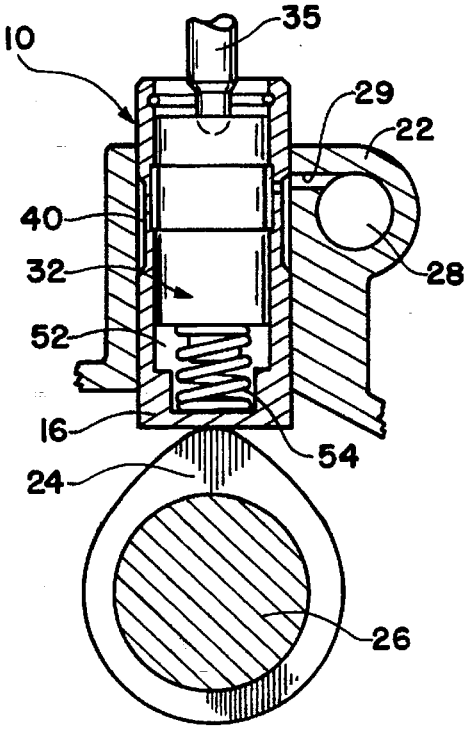
Figure 5:
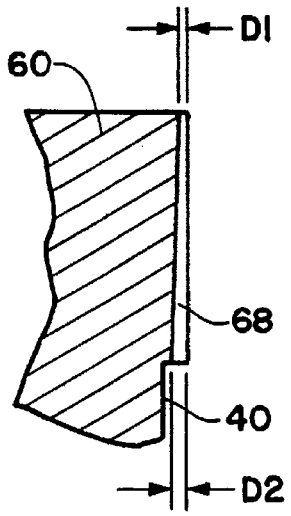
FIG. 5 is a cross sectional view taken along lines 5—5 of FIG. 4.
Figure 6:
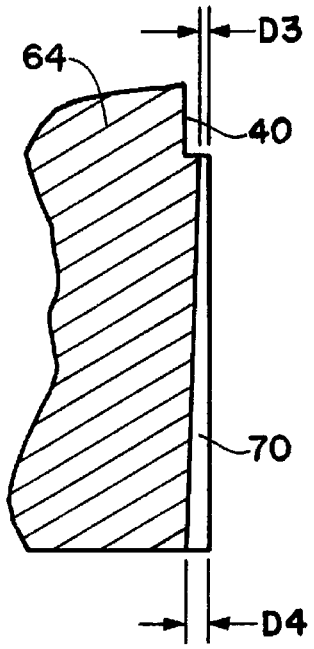
FIG. 6 is cross sectional view taken along lines 6—6 of FIG. 5.

The specific outer structure of hollow cylindrical plunger 32 is best described by referring to FIGS. 4–6 of the drawings. Hollow cylindrical plunger 32 has a upper portion 60 having a top edge 61 and a bottom edge 62. Hollow cylindrical plunger 32 also has a lower portion 64 having a top edge 65 and a bottom edge 66. A groove 68 is formed in the outer surface of upper portion 60 and it has a width W1 at its top end and a width W2 at its bottom end. Lower portion 64 has a groove 70 extending from its top edge 65 to its bottom edge 66. It has a width W3 at its top end and a width W4 at its bottom end. Groove 68 also has a depth D1 at its top end and a depth D2 at its bottom end. Groove 70 has depth D3 at its top end and a depth D4 at its bottom end. D2 is greater than D1 and D4 is greater than D3.

Figure 7:
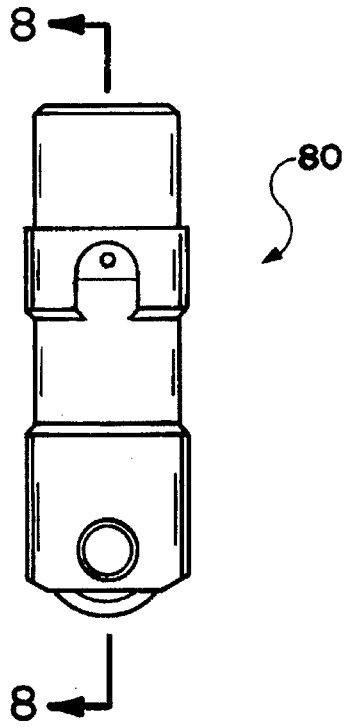
FIG. 7 is a front elevation view of a variable duration hydraulic roller valve lifter.
Figure 8:
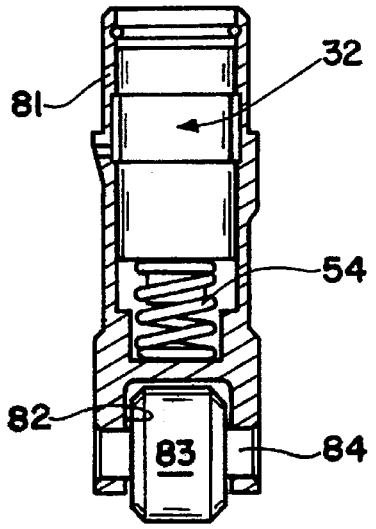
FIG. 8 is a cross sectional view taken along lines 8—8 of FIG. 7.

An alternative embodiment is illustrated in FIGS. 7 and 8 and it is variable duration hydraulic roller valve lifter 80. It has a cylindrical body 81 having a cavity 82 formed in its bottom end that receives a roller 83. Roller 83 is mounted on a shaft or pin 84. A hollow cylindrical plunger 32 similar to that described previously is axially slidably received in cylindrical body 81.

What is claimed is:

1. A variable duration hydraulic valve lifter comprising:

a hollow cylindrical body with a closed lower end for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a width W1 at its top edge and a width W2 at its bottom edge and W2 is greater than W1;

said lower portion having a top edge and a bottom edge, a lower groove extending from said top edge to said bottom edge of the lower portion respective along the outer cylindrical surface of the plunger; said lower groove having a width W3 at its top edge and a width W4 at its bottom edge and W4 is greater than W3;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

2. A variable duration hydraulic valve lifter as recited in claim 1 wherein W2 is greater than W3.

3. A variable duration hydraulic valve lifter as recited in claim 1 wherein W1 is in the range of 0.0042–0.0612 inches and W2 is in the range of 0.0150–0.0625 inches.

4. A variable duration hydraulic valve lifter as recited in claim 1 wherein W3 is in the range of 0.0042–0.0612 inches and W4 is in the range of 0.0150–0.0625 inches.

5. A variable duration hydraulic valve lifter as recited in claim 1 wherein said upper groove has a depth D1 at its top edge and a depth D2 at its bottom edge and D2 is greater than D1.

6. A variable duration hydraulic valve lifter as recited in claim 5 wherein D1 is in the range of 0.0075–0.0150 inches and D2 is in the range of 0.0080–0.0180 inches.

7. A variable duration hydraulic valve lifter as recited in claim 5 wherein said lower groove has a depth D3 at its top edge and a depth D4 at its bottom edge, D3 is in the range of 0.0075–0.0150 inches and D4 is in the range of 0.0080–0.0180 inches.

8. A variable duration hydraulic valve lifter comprising:

a hollow cylindrical body having a closed lower end with a cavity therein, a roller rotatably mounted in said cavity for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a width W1 at its top edge and a width W2 at its bottom edge and W2 is greater than W1;

said lower portion having a top edge end a bottom edge, a lower groove extending from said top edge to said bottom edge of the lower portion respectively along the outer cylindrical surface of the plunger; said lower groove having a width W3 at its top edge and a width W4 at its bottom edge and W4 is greater than W3;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

9. A variable duration hydraulic valve lifter as recited in claim 8 wherein W2 is greater than W3.

10. A variable duration hydraulic valve lifter as recited in claim 8 wherein W1 is in the range of 0.0042–0.0612 inches and W2 is in the range of 0.0150–0.0625 inches.

11. A variable duration hydraulic valve lifter as recited in claim 8 wherein W3 is in the range of 0.0042 and 0.0612 inches and W4 is in the range of 0.0150–0.0625 inches.

12. A variable duration hydraulic valve lifter as recited in claim 8 wherein said upper groove has a depth D1 oh its top edge and a depth D2 at its bottom edge and D2 is greater than D1.

13. A variable duration hydraulic valve lifter as recited in claim 12 wherein D2 is in the range of 0.0075–0.0150 inches and D2 is in the range of 0.0080–0.0180 inches.

14. A variable duration hydraulic valve lifter as recited in claim 12 wherein said lower groove has a depth D3 at its top edge and a depth D4 at its bottom edge, D3 is in the range of 0.0075–0.0150 inches and D4 is in the range of 0.0080–0.0180 inches.

15. A variable duration hydraulic valve lifter comprising:

a hollow cylindrical body with a closed lower end for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a width W1 at its top edge and a width W2 at its bottom edge and W2 is greater than W1;

said lower portion having a top edge and a bottom edge, a lower groove extending from said top edge to said bottom edge of the lower portion respectively along the outer cylindrical surface of the plunger;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

16. A variable duration hydraulic valve lifter comprising:

a hollow cylindrical body having a closed lower end with a cavity therein, a roller rotatably mounted in said cavity for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a width W1 at its top edge and a width W2 at its bottom edge and W2 is greater than W1;

said lower portion having a top edge and a bottom edge, a lower groove extending from said top edge to said bottom edge Of the lower portion respectively along the outer cylindrical surface of the plunger;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

17. A variable duration hydraulic valve lifter comprising:

a hollow cylindrical body with a closed lower end for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a depth D1 at its top edge and a depth D2 at its bottom edge and D2 is greater than D1;

said lower portion having a top edge and a bottom edge, a lower groove extending from said top edge to said bottom edge of the lower portion respectively along the outer cylindrical surface of the plunger;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

18. A variable duration hydraulic valve lifter comprising:

a hollow cylindrical body having a closed lower end with a cavity therein, a roller rotatably mounted in said cavity for engagement with a cam, said cylindrical body having an outer cylindrical surface and an upper end; an annular channel in the outer cylindrical surface of said cylindrical body for receiving oil from a pressurized source, said annular channel being located intermediate the upper end and the lower end of said cylindrical body; a port opening into the interior of said cylindrical body from said annular channel;

a hollow cylindrical plunger having a bottom wall with an outlet formed therein; said cylindrical plunger having an outer cylindrical surface, a top end and a bottom end; an annular peripheral channel is formed in the outer cylindrical surface of said cylindrical plunger and it is located intermediate its top end and its bottom end to form an upper portion and a lower portion; a port opening into the interior of said cylindrical plunger from said annular peripheral channel;

said upper portion having a top edge and a bottom edge, an upper groove extending from said top edge to said bottom edge along the outer cylindrical surface of the plunger; said upper groove having a depth D1 at its top edge and a depth D2 at its bottom edge and D2 is greater than D1;

said lower portion having a top edge and a bottom edge, a lower groove extending from said top edge to said bottom edge of the lower portion respectively along the outer cylindrical surface of the plunger;

said cylindrical plunger being axially slidable in said cylindrical body and enclosing a pressure chamber in the lower end of said cylindrical body; a return spring positioned in said pressure chamber to bias said plunger upwardly out of said cylindrical body; and a cap for the top end of said cylindrical plunger and means for retaining said cap within said cylindrical body.

* * * * *